US011945556B2

(12) United States Patent
Nakatani

(10) Patent No.: US 11,945,556 B2
(45) **Date of Patent: *Apr. 2, 2024**

(54) POSTURE CONTROL SYSTEM FOR HULL, CONTROL METHOD THEREFOR, AND MARINE VESSEL

(71) Applicant: YAMAHA HATSUDOKI KABUSHIKI KAISHA, Iwata (JP)

(72) Inventor: Jun Nakatani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 473 days.

This patent is subject to a terminal disclaimer.

(21) Appl. No.: 17/111,543

(22) Filed: Dec. 4, 2020

(65) Prior Publication Data

US 2021/0188406 A1 Jun. 24, 2021

(30) Foreign Application Priority Data

Dec. 19, 2019 (JP) ..... 2019-229001

(51) Int. Cl.

| | |
|---|---|
| ***B63B 39/00*** | (2006.01) |
| ***B63B 79/10*** | (2020.01) |
| ***B63B 79/40*** | (2020.01) |
| ***B63H 21/14*** | (2006.01) |
| ***B63H 21/21*** | (2006.01) |

(52) U.S. Cl.

CPC ..... *B63B 39/00* (2013.01); *B63B 79/10* (2020.01); *B63B 79/40* (2020.01); *B63H 21/14* (2013.01); *B63H 2021/216* (2013.01)

(58) Field of Classification Search

CPC ..... B63B 39/00; B63B 39/061; B63B 79/10; B63B 79/40; B63H 20/10; B63H 21/14; B63H 2021/216

USPC ..... 114/284, 285; 701/21

See application file for complete search history.

(56) References Cited

U.S. PATENT DOCUMENTS 5,474,012 A * 12/1995 Yamada ..... B63B 39/061 114/286
7,311,058 B1 * 12/2007 Brooks ..... B63B 79/10 114/285
8,261,682 B1 * 9/2012 DeVito ..... G05D 1/0875 701/21
9,682,758 B2 * 6/2017 Kuriyagawa ..... B63H 20/10

(Continued)

FOREIGN PATENT DOCUMENTS

JP 09-76992 A 3/1997
JP 09-286390 A 11/1997

(Continued)

OTHER PUBLICATIONS

Zipwake, "Operators Manual Dynamic Trim Control System", Retrieved from the Internet http://www.zipwake.com, retrieved on Jun. 3, 2020, 147 pages.

*Primary Examiner* — Daniel V Venne
(74) *Attorney, Agent, or Firm* — Keating & Bennett, LLP

(57) ABSTRACT

A posture control system for a hull includes trim tab main bodies as posture control plates attached to a stern of the hull to control the posture of the hull. Trim tab actuators drive the trim tab main bodies. Engines generate a propulsive force on the hull. A controller controls the trim tab actuators. Based on a throttle opening angle of the engines, the controller determines a time when the trim tab main bodies are to be lowered by the trim tab actuators.

19 Claims, 12 Drawing Sheets

(56) References Cited

U.S. PATENT DOCUMENTS

| | | | | |
|---|---|---|---|---|
| 11,453,467 | B2 * | 9/2022 | Inoue | B63B 1/22 |
| 2001/0051476 | A1 | 12/2001 | Harada et al. | |

FOREIGN PATENT DOCUMENTS

| | | | |
|---|---|---|---|
| JP | 2001-152898 | A | 6/2001 |
| JP | 2001-294197 | A | 10/2001 |

* cited by examiner

POSTURE CONTROL SYSTEM FOR HULL, CONTROL METHOD THEREFOR, AND MARINE VESSEL

CROSS REFERENCE TO RELATED APPLICATIONS

This application claims the benefit of priority to Japanese Patent Application No. 2019-229001 filed on Dec. 19, 2019. The entire contents of this application are hereby incorporated herein by reference.

BACKGROUND OF THE INVENTION

1. Field of the Invention

The present invention relates to a posture control system for a hull, a control method therefor, and a marine vessel.

2. Description of the Related Art

Conventionally, a planing boat has posture control plates such as trim tabs on a port side and a starboard side of a stern (see, for example, Japanese Laid-open Patent Publication (Kokai) No. 2001-294197 and Zipwake "Dynamic Trim-Control System" (URL: http://www.zipwake.com; hereafter referred to as Zipwake)). The planing boat moves the posture control plates up and down to control the posture of a hull, in particular, the pitch angle of the hull. For example, according to a technique described in Japanese Laid-open Patent Publication (Kokai) No. 2001-152898, the posture of the hull is controlled by moving the trim tabs based on information on an engine rpm, speed, acceleration, steering angle, and so forth.

As the planing boat accelerates, it shifts into a hump state due to upward movement of a bow (bow-up). In the hump state, resistance is increased, and thus the planing boat cannot smoothly accelerate, causing fuel efficiency to decrease. To resolve the hump state, the bow is lowered by moving down the posture control plates. Conventionally, a time when the posture control plates are lowered is the time when the rpm of an engine reaches an rpm corresponding to a speed at which the planing boat shifts into the hump state.

However, it takes a certain period of time to lower the posture control plates, and thus, if the posture control plates are lowered at the time when the engine has reached the rpm corresponding to the speed at which the planing boat shifts into the hump state, the hump state may last longer than expected. For this reason, there is room for improvement of fuel efficiency.

SUMMARY OF THE INVENTION

Preferred embodiments of the present invention provide posture control systems that each improve fuel efficiency.

According to a preferred embodiment of the present invention, a posture control system for a hull includes a posture control plate attachable to a stern of the hull to control a posture of the hull, a driver to drive the posture control plate, an engine to generate a propulsive force on the hull, and a controller configured or programmed to control the driver, wherein, based on a throttle opening angle of the engine, the controller is configured or programmed to determine a time when the posture control plate is to be lowered by the driver.

According to a preferred embodiment of the present invention, a posture control system for a hull includes a posture control plate attachable to a stern of the hull to control a posture of the hull, a driver to drive the posture control plate, an engine to generate a propulsive force on the hull, and a controller configured or programmed to control the driver, wherein, based on an operated amount of a throttle operator, the controller is configured or programmed to determine a time when the posture control plate is to be lowered by the driver.

According to the above preferred embodiments, the time when the posture control plate is lowered is determined based on the throttle opening angle of the engine or the operated amount of the throttle operator. Thus, lowering of the posture control plate is started without waiting for the engine to increase to an rpm corresponding to the predetermined speed, and thus if it takes time to lower the posture control plate, the posture control plate is lowered before the hull reaches the predetermined speed. As a result, the hump state is prevented from lasting longer than expected, and fuel efficiency is improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
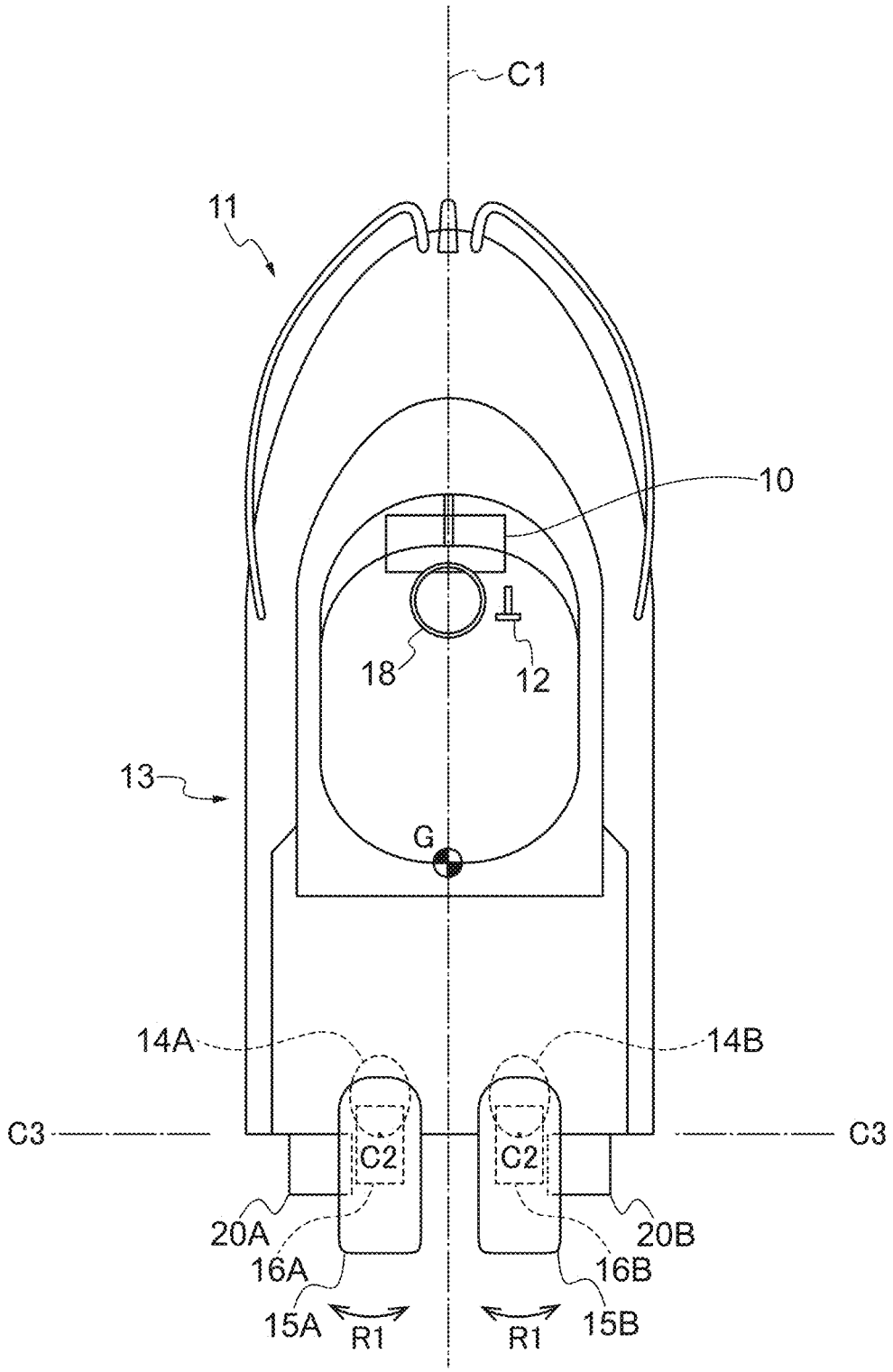
FIG. 1 is a top view of a marine vessel to which a posture control system for a hull according to a preferred embodiment of the present invention is applied.

FIG. 1 is a top view of a marine vessel to which a posture control system for a hull according to a preferred embodiment of the present invention is applied. The marine vessel 11 is a planing boat and includes a hull 13, a plurality of (for example, two) outboard motors (outboard motors 15A, 15B in FIG. 1) as marine propulsion devices mounted on the hull 13, and a plurality of (for example, a pair of) trim tab units (trim tab units 20A, 20B in FIG. 1). A central unit 10, a steering wheel 18, and a throttle lever 12 (throttle operator) are provided in the vicinity of a cockpit in the hull 13.

In the following description, a fore-and-aft direction, a crosswise direction, and a vertical direction mean a fore-and-aft direction, a crosswise direction, and a vertical direction, respectively, of the hull 13. For example, as shown in FIG. 1, a centerline C1 extending in the fore-and-aft direction of the hull 13 passes through the center of gravity G of the marine vessel 11. The fore-and-aft direction is a direction along the centerline C1. Fore means a direction toward the upper side of the view along the centerline C1. Aft means a direction toward the lower side of the view along the centerline C1. The crosswise direction is based on a case in which the hull 13 is seen from behind. The vertical direction is vertical to the fore-and-aft direction and the crosswise direction.

The two outboard motors 15A and 15B are attached to a stern of the hull 13 side by side. To distinguish the two outboard motors 15A and 15B, the one located on the port side is referred to as the "outboard motor 15A", and the one located on the starboard side is referred to as the "outboard motor 15B". The outboard motors 15A and 15B are mounted on the hull 13 via mounting units 14A an 14B, respectively. The outboard motors 15A and 15B have respective engines 16A and 16B, which are preferably internal combustion engines. The outboard motors 15A and 15B obtain propulsive forces from propellers (not illustrated) which are rotated by driving forces of the corresponding engines 16A and 16B.

Figure 3:
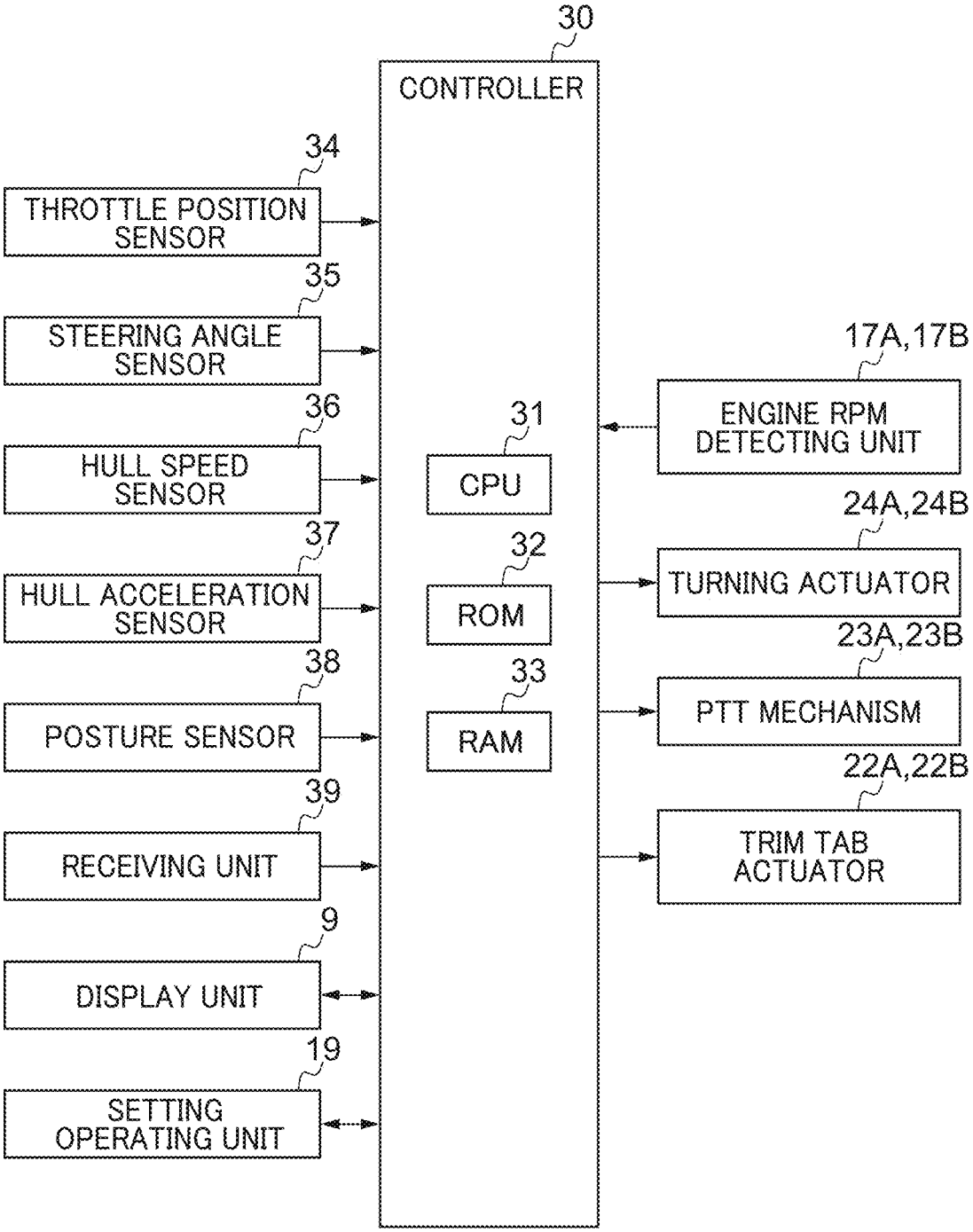
FIG. 3 is a block diagram of a maneuvering system.

The mounting units 14A and 14B each include a swivel bracket, a cramp bracket, a steering shaft, and a tilt shaft (none of them is illustrated). The mounting units 14A and 14B also include power trim and tilt mechanisms (PTT mechanisms) 23A and 23B, respectively (FIG. 3). The PTT mechanisms 23A and 23B rotate the corresponding outboard motors 15A and 15B about the tilt shaft. This makes it possible to change the tilt angle of the outboard motors 15A and 15B with respect to the hull 13, and thus a trim adjustment is able to be made, and the outboard motors 15A and 15B are tilted up and down. Moreover, the outboard motors 15A and 15B are able to rotate about a center of rotation C2 (about the steering shaft) with respect to the swivel bracket. By operating the steering wheel 18, the outboard motors 15A and 15B are rotated about the center of rotation C2 in the crosswise direction (direction R1). Thus, the marine vessel 11 is steered.

The pair of trim tab units 20A and 20B are attached to the stern on the port side and the starboard side such that they are able to swing about a swing axis C3. To distinguish the two trim tabs 20A and 20B, the one located on the port side is referred to as the "trim tab unit 20A", and the one located on the starboard side is referred to as the "trim tab unit 20B".

Figure 2:
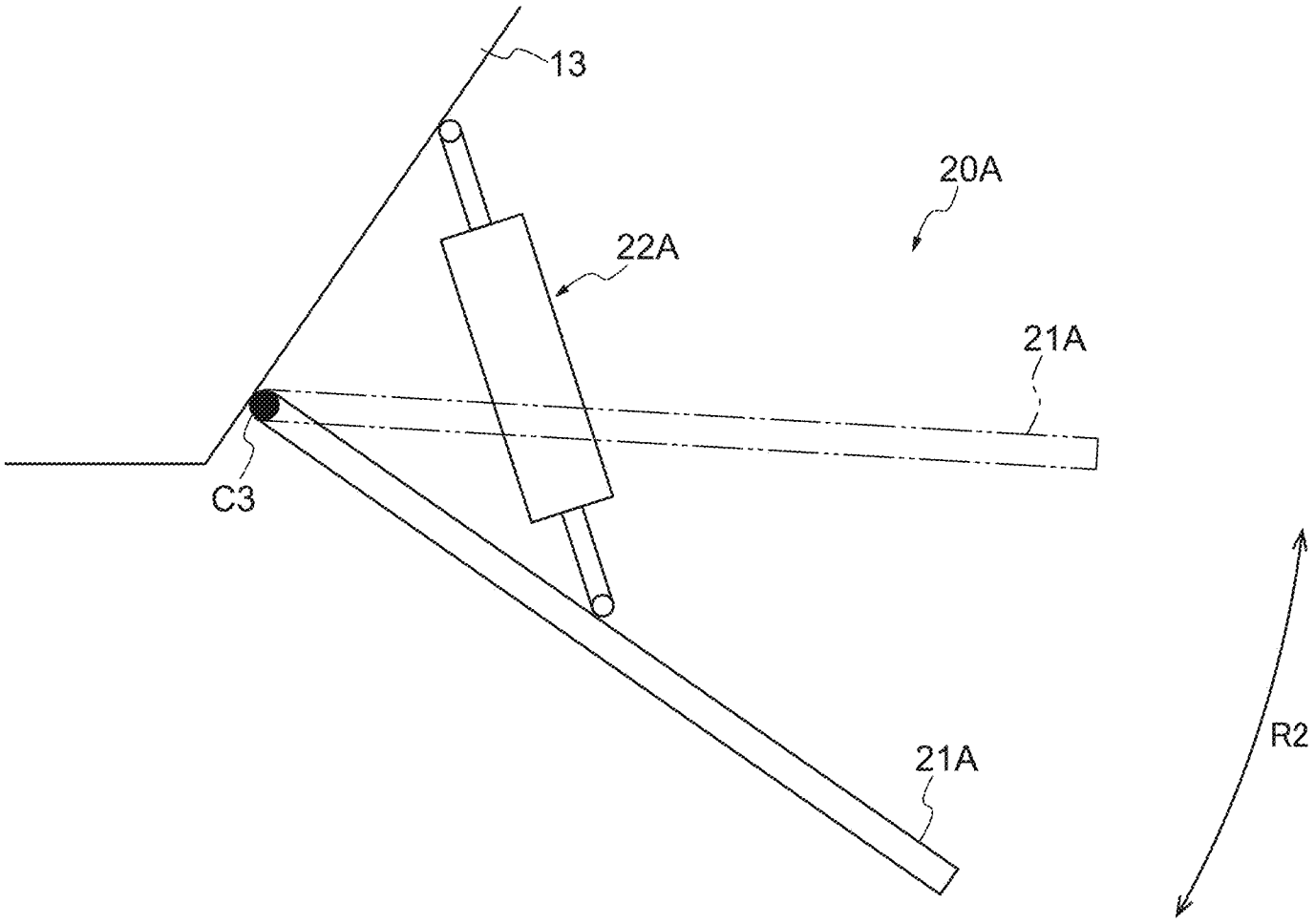
FIG. 2 is a side view of a trim tab attached to the hull.

FIG. 2 is a side view of the trim tab unit 20A attached to the hull 13. The trim tab units 20A and 20B have the same construction, and thus a construction of only the trim tab unit 20A will be described. The trim tab unit 20A includes a trim tab actuator 22A (driver) and a tab main body 21A. The tab main body 21A is attached to the rear of the hull 13 such that it is able to swing about the swing axis C3. For example, a base end portion of the tab main body 21A is attached to the rear of the hull 13, and a free end portion of the tab main body 21A swings up and down (in a swinging direction R2) about the swing axis C3. The tab main body 21A is an example of a posture control plate that controls the posture of the hull 13.

The trim tab actuator 22A is located between the tab main body 21A and the hull 13 such that it connects the tab main body 21A and the hull 13 together. The trim tab actuator 22A drives the tab main body 21A to swing it with respect to the hull 13. It should be noted that the tab main body 21A indicated by a chain double-dashed line in FIG. 2 is at a position where its free end portion is at the highest level (a position at which the amount of descent is 0%), and this position corresponds to a retracted position. The tab main body 21A indicated by a solid line in FIG. 2 is at a position where its free end portion is at a lower level than a keel at the bottom of the marine vessel 11. It should be noted that a range where the tab main body 21A is able to swing is not limited to the one illustrated in FIG. 2. The swinging direction R2 is defined with reference to the swing axis C3. The swing axis C3 is perpendicular or substantially perpendicular to the centerline C1 and parallel or substantially parallel to, for example, the crosswise direction. It should be noted that the swing axis C3 may extend diagonally so as to cross the center of rotation C2.

FIG. 3 is a block diagram of a maneuvering system. The maneuvering system includes the posture control system according to a preferred embodiment of the present invention. The marine vessel 11 includes a controller 30, a throttle position sensor 34, a steering angle sensor 35, a hull speed sensor 36, a hull acceleration sensor 37, a posture sensor 38, a receiving unit 39, a display unit 9, and a setting operating unit 19. The marine vessel 11 also includes engine rpm detecting units 17A and 17B, turning actuators 24A and 24B, the PTT mechanisms 23A and 23B, the trim tab actuators 22A and 22B (see FIG. 2 as well).

The controller 30, the throttle position sensor 34, the steering angle sensor 35, the hull speed sensor 36, the hull acceleration sensor 37, the posture sensor 38, the receiving unit 39, the display unit 9, and the setting operating unit 19 are included in the central unit 10 or disposed in the vicinity of the central unit 10. The turning actuators 24A and 24B and the PTT mechanisms 23A and 23B are provided for the corresponding outboard motors 15A and 15B. The engine rpm detecting units 17A and 17B are provided in the corresponding outboard motors 15A and 15B. The trim tab actuators 22A and 22B are included in the trim tabs 20A and 20B, respectively.

The controller 30 includes a CPU 31, a ROM 32, a RAM 33, and a timer, which is not illustrated. The ROM 32 stores control programs. The CPU 31 expands the control programs stored in the ROM 32 into the RAM 33 and executes them to implement various types of control processes. The RAM 33 provides a work area for the CPU 31 to execute the control program.

Results of detection by the sensors 34 to 39 and the engine rpm detecting units 17A and 17B are provided to the controller 30. The throttle position sensor 34 detects the opening angle of a throttle valve, which is not illustrated. It should be noted that the opening angle of the throttle valve varies according to the operated amount of the throttle lever 12. The steering angle sensor 35 detects the rotational angle of the steering wheel 18 that has been rotated. The hull speed sensor 36 and the hull acceleration sensor 37 detect the speed and acceleration, respectively, of the marine vessel 11 (the hull 13) while it is sailing.

The posture sensor 38 includes, for example, a gyro sensor, a magnetic direction sensor, and so forth. Based on a signal output from the posture sensor 38, the controller 30 calculates a roll angle, a pitch angle, and a yaw angle. It should be noted that the controller 30 may calculate the roll angle and the pitch angle based on a signal output from the hull acceleration sensor 37. The receiving unit 39 includes a GNSS (Global Navigation Satellite Systems) receiver such as a GPS and has a function of receiving GPS signals and various types of signals as positional information. From a speed restriction zone or land in its vicinity, an identification signal for providing notification that an area is a speed restriction zone is transmitted. The speed restriction zone means an area in a harbor or the like where marine vessels are required to limit their speed to a predetermined speed or lower. The receiving unit 39 also has a function of receiving the identification signal. It should be noted that the acceleration of the hull 13 may also be obtained from a GPS signal received by the receiving unit 39.

The engine rpm detecting units 17A and 17B detect the number of revolutions of the corresponding engines 16A and 16B per unit time (hereafter referred to as "the engine rpm"). The display unit 9 displays various types of information. The setting operating unit 19 includes an operator to perform operations relating to maneuvering, a PTT operating switch, a setting operator to make various settings, and an input operator to input various types of instructions (none of them is illustrated).

The turning actuators 24A and 24B rotate the corresponding outboard motors 15A and 15B about the center of rotation C2 with respect to the hull 13. The rotation of the outboard motors 15A and 15B about the center of rotation C2 changes a direction in which a propulsion force acts with respect to the centerline C1 of the hull 13. The PTT mechanisms 23A and 23B tilt the corresponding outboard motors 15A and 15B with respect to the clamp bracket by rotating the corresponding outboard motors 15A and 15B about the tilt shaft. The PTT mechanisms 23A and 23B are activated by, for example, operating the PTT operating switch. As a result, the tilt angle of the outboard motors 15A and 15B with respect to the hull 13 is changed.

The trim tab actuators 22A and 22B are controlled by the controller 30. For example, the controller 30 operates the trim tab actuators 22A and 22B by outputting control signals to them. The operation of the trim tab actuators 22A and 22B, which correspond to the drivers, swings the corresponding tabs 21A and 21B. It should be noted that actuators used for the PTT mechanisms 23A and 23B and the trim tab actuators 22A and 22B may be either a hydraulic type or an electric type.

It should be noted that the controller 30 may obtain results of detection by the engine rpm detecting units 17A and 17B via a remote control ECU, which is not illustrated. The controller 30 may also control each of the engines 16A and 16B via outboard motor ECUs (not illustrated) provided in the respective outboard motors 15A and 15B.

When the marine vessel 11, which is a planing boat, is sailing at low speed, for example, at several km/h, a large lift is not generated at the bottom of the hull 13, and as with displacement-type marine vessels, buoyant force mainly acts on the entire hull 13. Thus, when the marine vessel 11 is sailing at low speed, the hull 13 is kept substantially horizontal, and the pitch angle is kept at substantially 0 degrees, as shown in FIG. 4A.

Figure 4A:
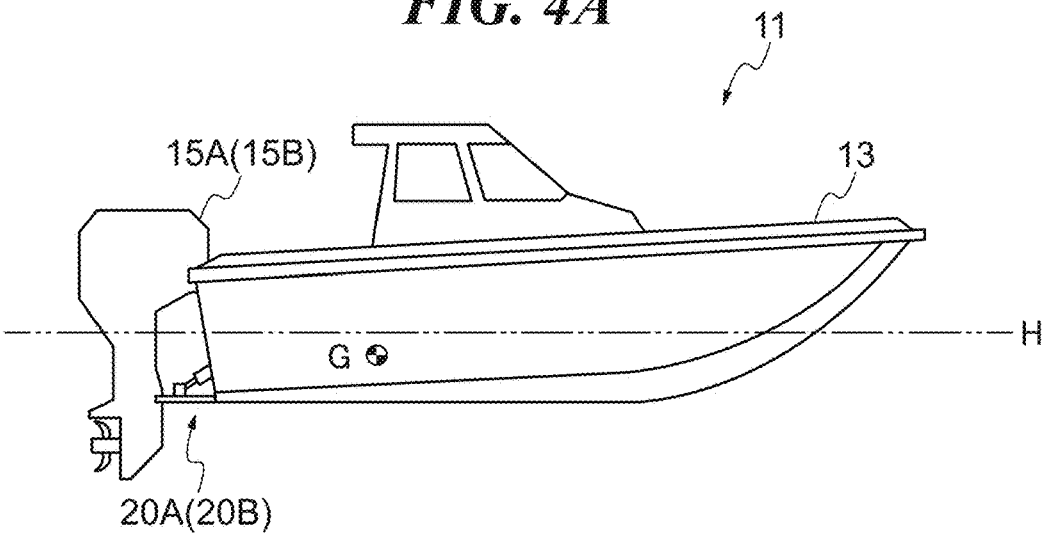
FIGS. 4A to 4C are views useful in explaining changes in the posture of the marine vessel during acceleration.
Figure 4B:
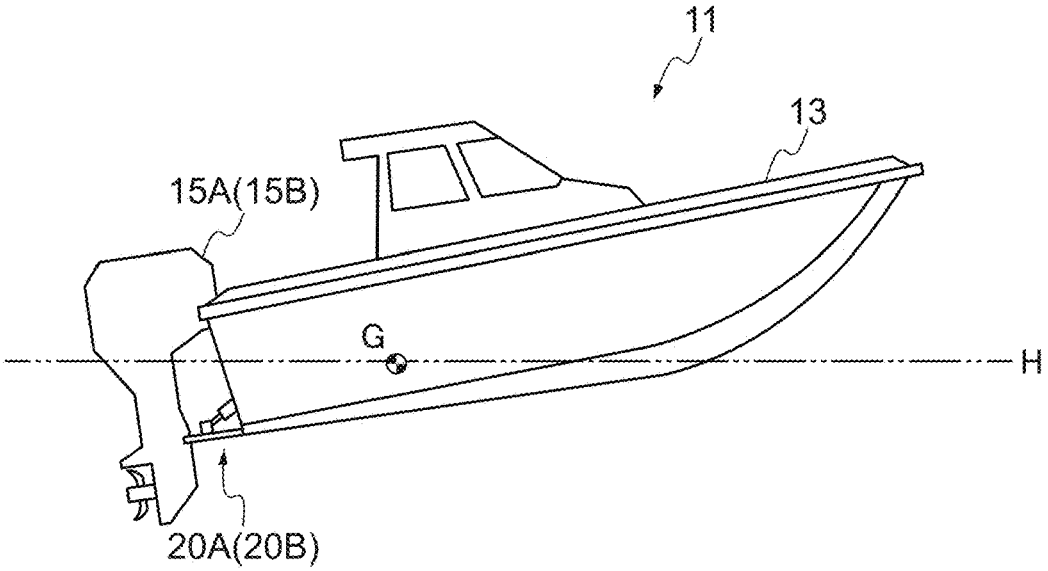
Figure 4C:
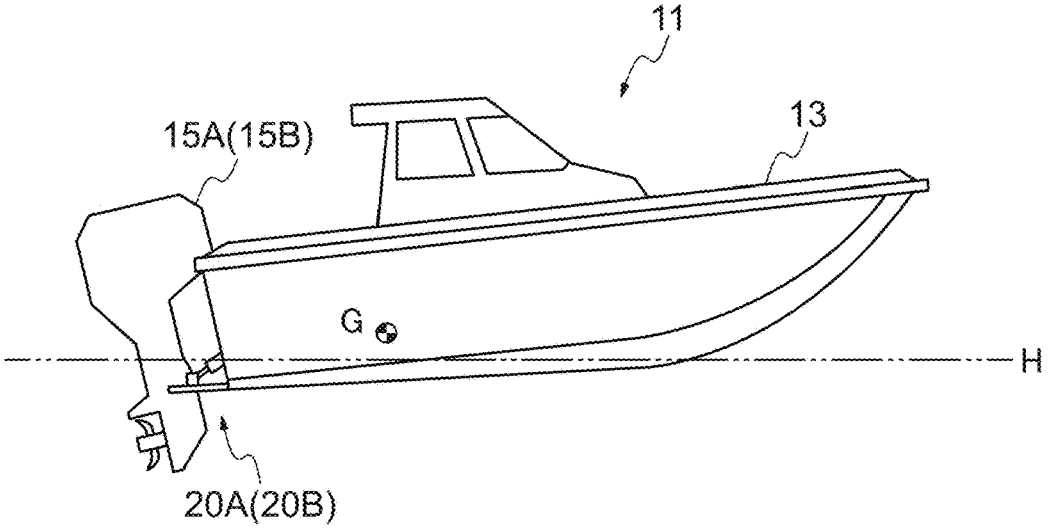

After that, when the marine vessel 11 accelerates and reaches, for example, a speed of about 10 to about 20 km/h, the stern of the hull 13 sinks into a valley of waves generated by the bow of the hull 13, resulting in the bow being raised to bring the marine vessel 11 into a hump state (FIG. 4B). Since the stern of the hull 13 sinks in the hump state, the pitch angle increases to, for example, about 7 degrees to about 8 degrees.

When the marine vessel 11 further accelerates and reaches, for example, a speed of more than about 30 km/h, lift generated at the bottom of the hull 13 significantly increases, and as shown in FIG. 4A, the hull 13 shifts into a planing state. In the planing state, waves generated by the bow of the hull 13 have a long wavelength due to the high speed, the stern never sinks into a valley of the waves, and lift acts on the entire bottom surface of the hull 13. As a result, not only the bow but also the stern rises, making the pitch angle of the hull 13 smaller than in the hump state.

As described above, in the hump state, the pitch angle of the hull 13 is large, and the angle which the bottom of the hull 13 defines with respect to a water surface H (indicated by a chain double-dashed line) while sailing increases, making the bottom of the hull 13 more likely to contact the water. For this reason, a resistance acting on the bottom of the hull 13 becomes very large.

Figure 5:
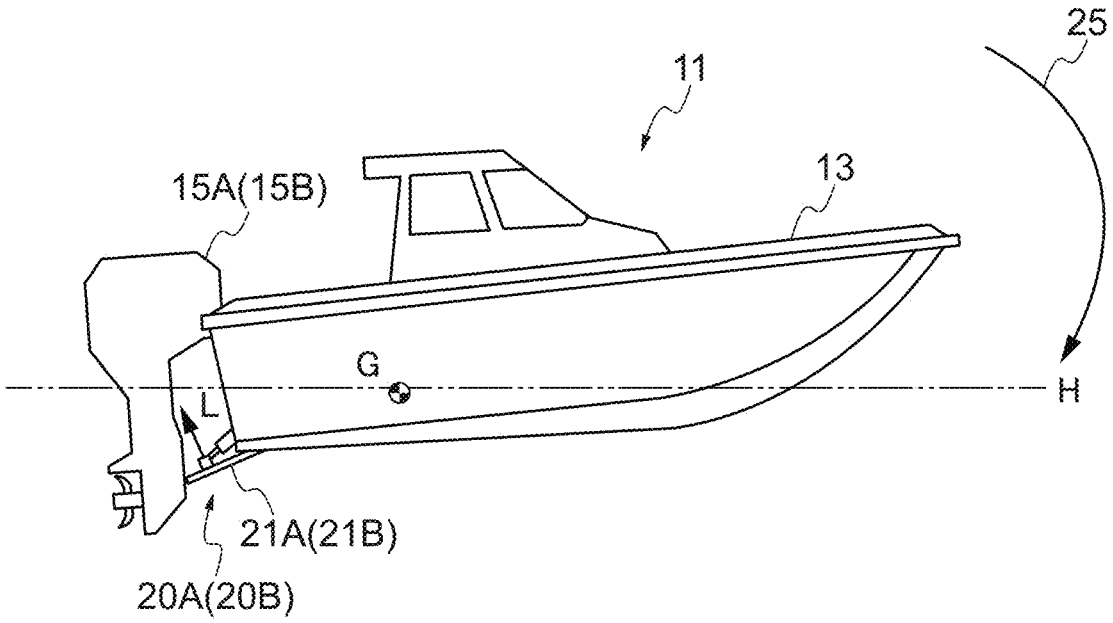
FIG. 5 is a view useful in explaining a method for decreasing the pitch angle of the hull in a hump state.

To cope with this, the pitch angle of the hull 13 in the hump state is decreased by lowering the tab main bodies 21A and 21B of the trim tab units 20A and 20B. As shown in FIG. 5, when the tab main bodies 21A and 21B of the trim tab units 20A and 20B are lowered, lift L is generated by the tab main bodies 21A and 21B, and a bow-down moment 25 around the center of gravity G is generated in the hull 13. This causes the bow to move down and reduces the pitch angle of the hull 13. When the pitch angle has decreased, the angle with which the bottom of the hull 13 defines with respect to with the water surface H decreases, and thus during sailing, the bottom of the hull 13 is less likely to receive water. As a result, the resistance acting on the bottom of the hull 13 is able to be decreased.

Figure 6:
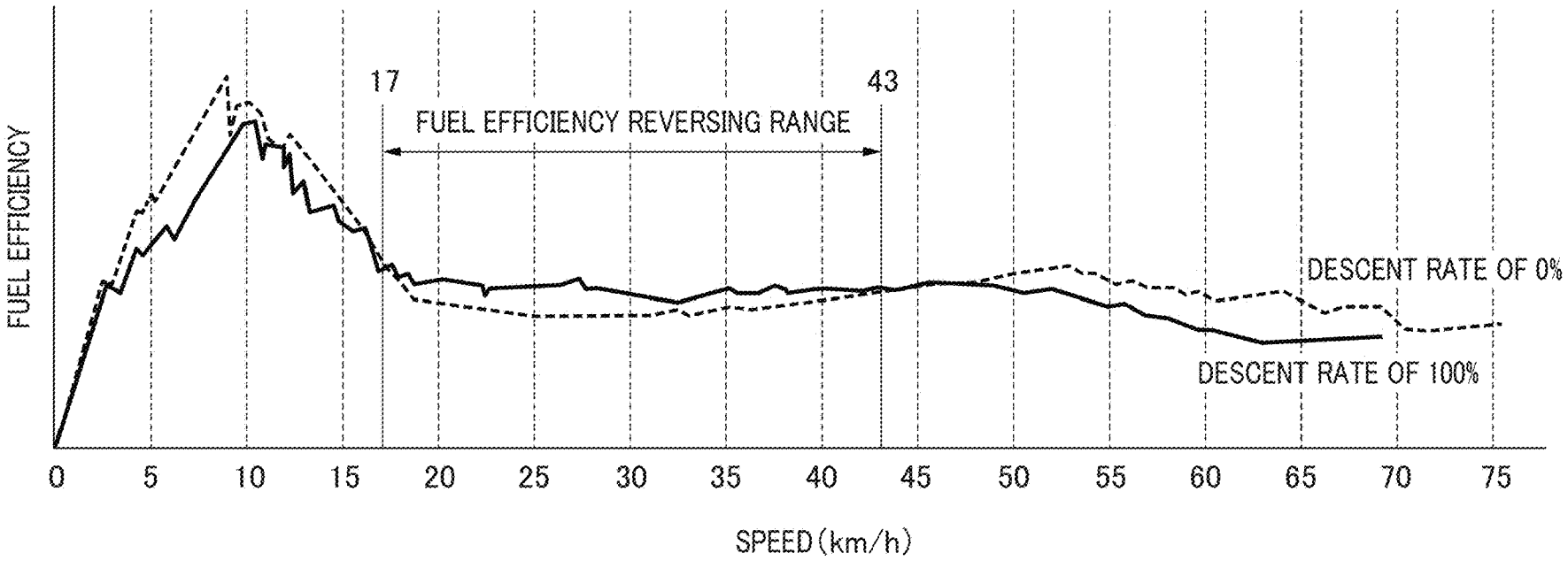
FIG. 6 is a graph showing the relationship between speed and fuel efficiency of the marine vessel.

FIG. 6 is a graph showing the relationship between the speed and fuel efficiency of the marine vessel 11. In FIG. 6, a broken line indicates changes in fuel efficiency at a descent rate of 0% at which free end portions of the tab main bodies 21A and 21B lie at the highest position, and a solid line indicates changes in fuel efficiency at a descent rate of 100% at which the free end portions of the tab main bodies 21A and 21B lie at the lowest position.

As shown in the graph of FIG. 6, the fuel efficiency at the descent rate of 0% is higher than the fuel efficiency at the descent rate of 100% until the speed of the marine vessel 11 reaches, for example, approximately 17 km/h. This is because while the marine vessel 11 is sailing at low speed, the hull 13 is kept substantially horizontal, and thus if the tab main bodies 21A and 21B of the trim tab units 20A and 20B are lowered, the tab main bodies 21A and 21B act as resistance plates, causing the fuel efficiency of the marine vessel 11 to decrease.

The fuel efficiency at the descent rate of 100% is higher than the fuel efficiency at the descent rate of 0% until the speed of the marine vessel 11 reaches, for example, approximately 43 km/h after reaching, for example, approximately 17 km/h. This is because when the speed of the marine vessel 11 has become higher than approximately 17 km/h, the marine vessel 11 shifts into the hump state, in which if the tab main bodies 21A and 21B of the respective trim tab units 20A and 20B are lowered, a bow-down moment 25 is generated to reduce the pitch angle of the hull 13, resulting in the resistance acting on the bottom of the hull 13 to be decreased.

When the marine vessel 11 further accelerates after reaching, for example, approximately 43 km/h, the fuel efficiency at the descent rate of 0% becomes higher again than the fuel efficiency at the descent rate of 100%. This is because when the speed of the marine vessel 11 has become higher than approximately 43 km/h, the marine vessel 11 shifts into the planing state, in which not only the bow but also the stern rises, resulting in the pitch angle of the hull 13 being decreased. Thus, if the tab main bodies 21A and 21B of the respective trim tab units 20A and 20B are lowered, the tab main bodies 21A and 21B act as resistance plates again, causing the fuel efficiency of the marine vessel 11 to decrease.

More specifically, when the marine vessel 11 accelerates, first, it reaches a speed (approximately 17 km/h in FIG. 6) at which the fuel efficiency is higher in the case in which the tab main bodies 21A and 21B are lowered than in the case in which the tab main bodies 21A and 21B are not lowered (hereafter referred to as a "first fuel efficiency reversing speed") (a predetermined speed). Further, when the marine vessel 11 continues to be accelerated even after it reaches the first fuel efficiency reversing speed, the marine vessel 11 reaches a speed (approximately 43 km/h in FIG. 6) at which the fuel efficiency is higher in the case in which the tab main bodies 21A and 21B are not lowered than in the case in which the tab main bodies 21A and 21B are lowered (hereafter referred to as a "second fuel efficiency reversing speed").

Accordingly, in the present preferred embodiment, before the marine vessel 11 reaches the first fuel efficiency reversing speed, the tab main bodies 21A and 21B of the respective trim tab units 20A and 20B are lowered so that the descent rate is, for example, 100%. Also, before the marine vessel 11 reaches the second fuel efficiency reversing speed, the tab main bodies 21A and 21B of the respective trim tab units 20A and 20B are raised so that the descent rate is, for example, 0%. It should be noted that the graph of FIG. 6 is merely one example, and the first fuel efficiency reversing speed and the second fuel efficiency reversing speed vary according to the shape and weight of the hull 13 of the marine vessel 11. For this reason, the relationship between the speed and fuel efficiency of the marine vessel 11 needs to be obtained whenever the shape and weight of the hull 13 of the marine vessel 13 change.

Moreover, in the present preferred embodiment, swinging of the tab main bodies 21A and 21B of the trim tab units 20A and 20B is controlled according to the speed of the marine vessel 11, and it takes a certain period of time, for example, about four seconds to lower the tab main bodies 21A and 21B of the trim tab units 20A and 20B from the position at which the descent rate is 0% to the position at which the descent rate is 100%. Thus, in the case in which lowering of the tab main bodies 21A and 21B of the trim tab units 20A and 20B is started at a time when the marine vessel 11 reaches the first fuel efficiency reversing speed, it takes a certain period of time to generate the bow-down moment 25, and hence the hump state of the marine vessel 11 lasts longer than expected.

Figure 7:
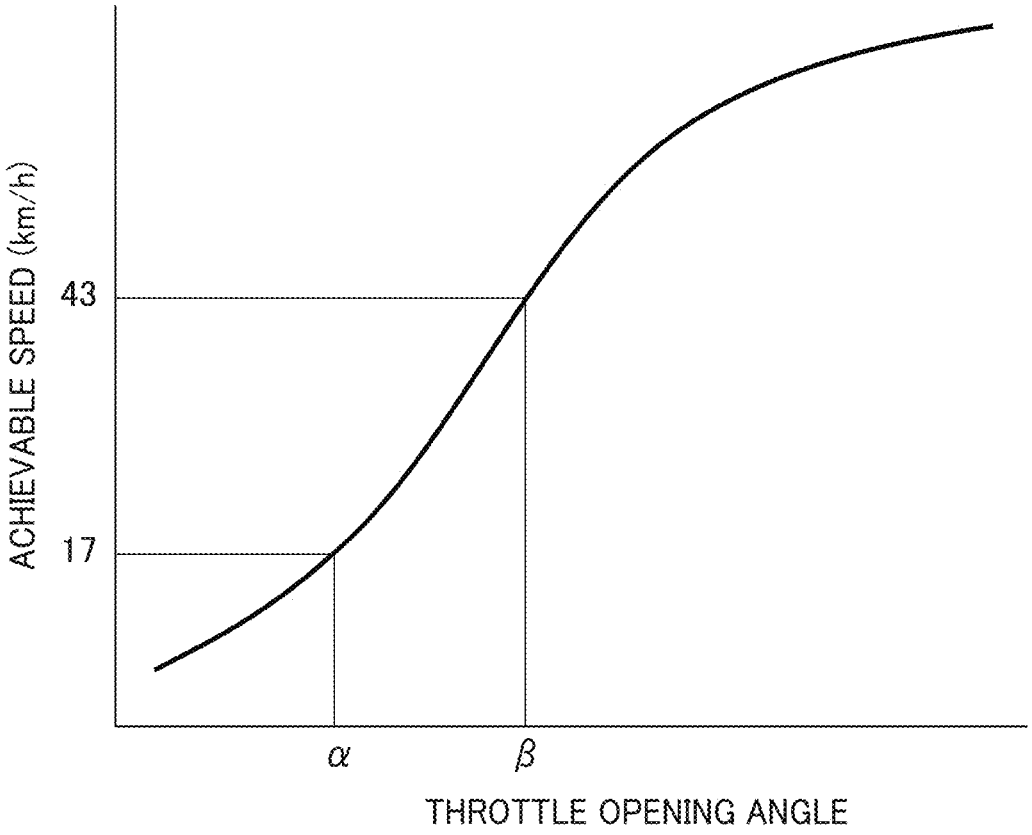
FIG. 7 is a graph showing the relationship between speed that is reached by the marine vessel and throttle opening angle.

Furthermore, a speed that can be achieved by the marine vessel 11 (hereafter referred to merely as an "achievable speed") depends on the throttle opening angle, and for example, as shown in FIG. 7, the achievable speed is uniquely determined with respect to the throttle opening angle. In the present preferred embodiment, a throttle opening angle at which the first fuel efficiency reversing speed (approximately 17 km/h in FIG. 6) is achievable is a first throttle opening angle $\alpha$ (for example, about 24%), and a throttle opening angle at which the second fuel efficiency reversing speed (approximately 43 km/h in FIG. 6) is achievable is a second throttle opening angle $\beta$. In other words, the first throttle opening angle $\alpha$ is a request to accelerate the marine vessel 11 to the first fuel efficiency reversing speed, and the second throttle opening angle $\beta$ is a request to accelerate the marine vessel 11 to the second fuel efficiency reversing speed.

Figure 8:
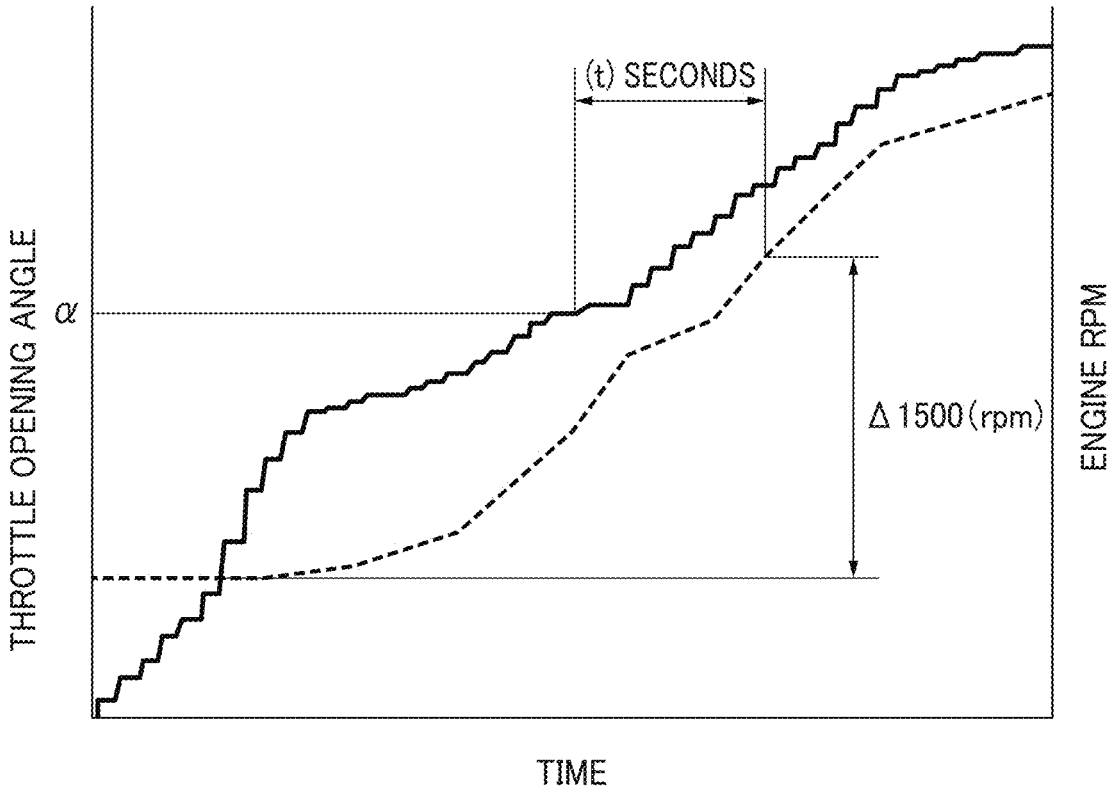
FIG. 8 is a view useful in explaining how an engine rpm follows the throttle opening angle.

FIG. 8 is a view useful in explaining how the engine rpm follows the throttle opening angle. In FIG. 8, a solid line indicates the throttle opening angle, and a broken line indicates the engine rpm. In the actual engines 16A and 16B, even if air and fuel supplied to the engines 16A and 16B are increased by further opening the throttle, the engine rpm does not immediately increase because of inertial mass of a piston or the like, and as shown in FIG. 8, the engine rpm lags behind the throttle opening angle while following the throttle opening angle. The amount by which the engine rpm lags behind the throttle opening angle is large particularly in a region where the throttle opening angle is small.

It should be noted that the engine rpm is substantially proportional to the speed of the marine vessel 11, and thus the speed of the marine vessel 11 also lags behind the throttle opening angle while following the throttle opening angle. For example, even when a user operates the throttle lever 12 to make the throttle opening angle correspond to the first throttle opening angle $\alpha$, it takes a predetermined period of time for the marine vessel 11 to achieve the first fuel efficiency reversing speed.

Figure 9:
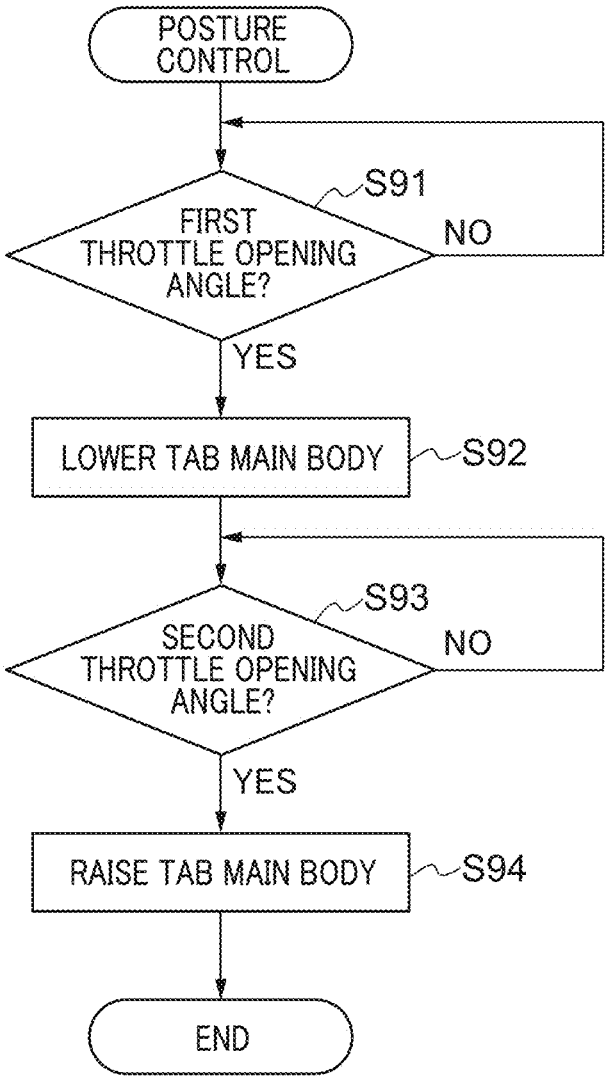
FIG. 9 is a flowchart showing a posture control process during acceleration of the marine vessel according to a preferred embodiment of the present invention.

FIG. 9 is a flowchart showing a posture control process during acceleration of the marine vessel 11 according to a preferred embodiment of the present invention. The process in FIG. 9 is implemented by the CPU 31 of the controller 30 executing a control program expanded in the RAM 33.

Referring to FIG. 9, when the marine vessel 11 is accelerating, first, whether or not the throttle opening angle has reached the first throttle opening angle $\alpha$ is judged in response to an operation on the throttle lever 12 by the user (step S91). Here, the throttle opening angle is determined according to the amount of the operation on the throttle lever 12, but the actual opening angles of the throttle valves in the respective engines 16A and 16B have be measured, and the judgment in step S91 may be made using the measured values.

In step S91, when the throttle opening angle has not reached the first throttle opening angle $\alpha$, the process returns to step S91. When the throttle opening angle has reached the first throttle opening angle $\alpha$, the controller 30 lowers the tab main bodies 21A and 21B using the respective trim tab actuators 22A and 22B so that the descent rate is, for example, 100% (step S92). Lowering the tab main bodies 21A and 21B causes the bow-down moment 25 around the center of gravity G to be generated in the hull 13 and lowers the raised bow to reduce the pitch angle of the hull 13.

Next, the marine vessel 11 maintains its accelerating state, and in response to an operation on the throttle lever 12 by the user, the controller 30 judges whether or not the throttle opening angle has reached the second throttle opening angle $\beta$ (step S93).

In step S93, when the throttle opening angle has not reached the second throttle opening angle $\beta$, the process returns to step S93. When the throttle opening angle has reached the second throttle opening angle $\beta$ (predetermined time), the controller 30 raises the tab main bodies 21A and 21B using the respective trim tab actuators 22A and 22B so that the descent rate is, for example, 0% (step S94). After that, the present process is ended.

According to the process in FIG. 9, when the throttle opening angle has reached the first throttle opening angle $\alpha$, the tab main bodies 21A and 21B are lowered. More specifically, the time when the tab main bodies 21A and 21B should be lowered is determined based on the throttle opening angle. As a result, lowering of the tab main bodies 21A and 21B is started without waiting for the speed of the marine vessel 11 to accelerate to the first fuel efficiency reversing speed. Thus, even if it takes a certain period of time to lower the tab main bodies 21A and 21B, the tab main bodies 21A and 21B are lowered before the speed of the marine vessel 11 reaches the first fuel efficiency reversing speed. As a result, the hump state is prevented from lasting longer than expected, and the fuel efficiency of the marine vessel 11 is improved.

In other words, in the process in FIG. 9, the tab main bodies 21A and 21B are lowered without waiting for the engine rpm to increase to the rpm corresponding to the first fuel efficiency reversing speed. Here, assume that the rpm corresponding to the first fuel efficiency reversing speed is an rpm that is about 1500 rpm higher than an rpm in an idling state (FIG. 8). In this case, if the tab main bodies 21A and 21B are lowered in a case in which the throttle opening angle reaches the first throttle opening angle $\alpha$, the tab main bodies 21A and 21B are lowered, for example, t seconds earlier than in a case in which the tab main bodies 21A and 21B are lowered after the engine rpm reaches the rpm corresponding to the first fuel efficiency reversing speed. Thus, the tab main bodies 21A and 21B are lowered before the engine rpm reaches the rpm corresponding to the first fuel efficiency reversing speed. Here, t seconds mentioned above corresponds to the predetermined period of time required for the speed of the marine vessel 11 to reach the first fuel efficiency reversing speed after the throttle opening angle reaches the first throttle opening angle $\alpha$. More specifically, in the present preferred embodiment, it can also be said that by using the predetermined period of time (t seconds), the tab main bodies 21A and 21B of the respective trim tab units 20A and 20B are lowered before the engine rpm reaches the rpm corresponding to the first fuel efficiency reversing speed.

Furthermore, in the process in FIG. 9, when the throttle opening angle has reached the second throttle opening angle $\beta$, the tab main bodies 21A and 21B are raised. As a result, the tab main bodies 21A and 21B are raised before the speed of the marine vessel 11 reaches the second fuel efficiency reversing speed. Thus, even if the marine vessel 11 shifts into the planing state, the tab main bodies 21A and 21B are prevented from acting as resistance plates while being kept down, and the fuel efficiency of the marine vessel 11 is improved.

Figure 10:
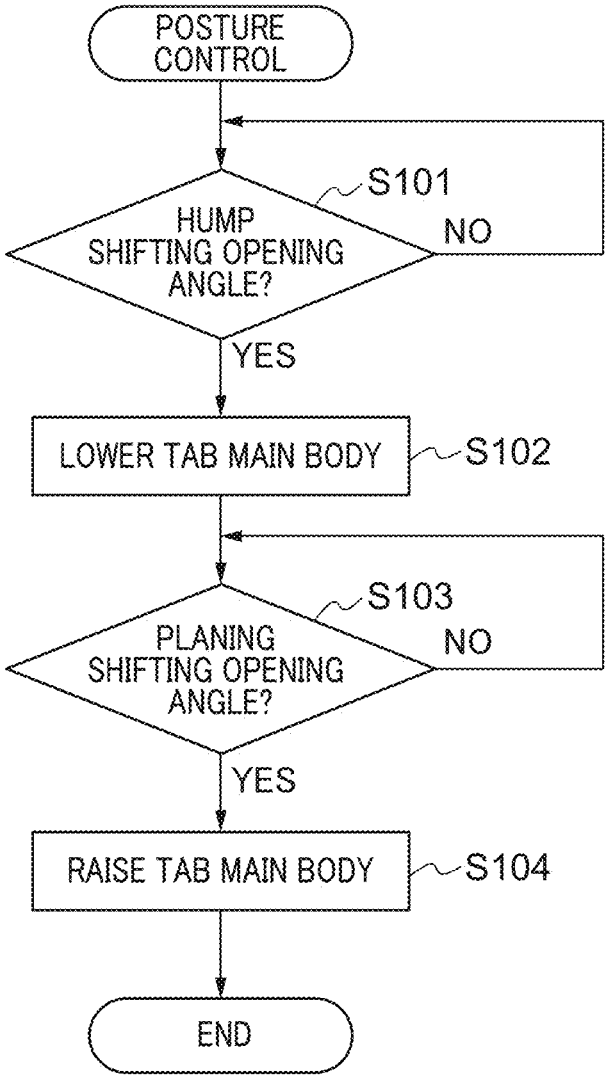
FIG. 10 is a flowchart showing a variation of the posture control process during acceleration of the marine vessel according to a preferred embodiment of the present invention.

FIG. 10 is a flowchart showing a variation of the posture control process during acceleration of the marine vessel 11 according to a preferred embodiment of the present invention. The process in FIG. 10 is also implemented by the CPU 31 of the controller 30 executing a control program expanded in the RAM 33. Here, a throttle opening angle at which a speed at which the marine vessel 11 shifts into the hump state is achievable is referred to as a "hump shifting opening angle", and a throttle opening angle at which a speed at which the marine vessel 11 shifts into the planing state is achievable is referred to as a "planing shifting opening angle". In other words, the hump shifting opening angle is a request to accelerate the marine vessel 11 to a speed at which the marine vessel 11 shifts into the hump state, and the planing shifting opening angle is a request to accelerate the marine vessel 11 to a speed at which the marine vessel 11 shifts into the planing state.

Referring to FIG. 10, when the marine vessel 11 is accelerating, first, whether or not the throttle opening angle has reached the hump shifting opening angle is judged in response to an operation on the throttle lever 12 by the user (step S101).

In step S101, when the throttle opening angle has not reached the hump shifting opening angle, the process returns to step S101. When the throttle opening angle has reached the hump shifting opening angle, the controller 30 lowers the tab main bodies 21A and 21B using the respective trim tab actuators 22A and 22B so that the descent rate is, for example, 100% (step S102).

Next, the marine vessel 11 maintains its accelerating state, and in response to an operation on the throttle lever 12 by the user, the controller 30 judges whether or not the throttle opening angle has reached the planing shifting opening angle (step S103).

In step S103, when the throttle opening angle has not reached the planing shifting opening angle, the process returns to step S103. When the throttle opening angle has reached the planing shifting opening angle, the controller 30 raises the tab main bodies 21A and 21B using the respective trim tab actuators 22A and 22B so that the descent rate is, for example, 0% (step S104). After that, the present process is ended.

According to the process in FIG. 10, when the throttle opening angle has reached the hump shifting opening angle, the tab main bodies 21A and 21B are lowered. Thus, the tab main bodies 21A and 21B are lowered before the speed of the marine vessel 11 has reached the speed at which it shifts into the hump state. When the throttle opening angle has reached the planing shifting opening angle, the tab main bodies 21A and 21B are raised. Thus, the tab main bodies 21A and 21B are raised before the speed of the marine vessel 11 has reached the speed at which it shifts into the planing state. As a result, the fuel efficiency of the marine vessel 11 is improved.

Although in a preferred embodiment of the present invention, swinging (lowering and raising) of the tab main bodies 21A and 21B of the respective trim tab units 20A and 20B is controlled according to the throttle opening angle, swinging of the tab main bodies 21A and 21B of the respective trim tab units 20A and 20B may be controlled according to a fuel injection quantity because the fuel injection quantity varies depending on the throttle opening angle. For example, the tab main bodies 21A and 21B may be lowered when the fuel injection quantity has reached a fuel injection quantity at which the first fuel efficiency reversing speed or the speed at which the marine vessel 11 shifts into the hump state is achievable. Also, the tab main bodies 21A and 21B may be raised when the fuel injection quantity has reached a fuel injection quantity at which the second fuel efficiency reversing speed or the speed at which the marine vessel 11 shifts into the planing state is achievable.

Moreover, although in a preferred embodiment of the present invention, the throttle opening angle is determined based on the operated amount of the throttle lever 12, the throttle opening angle may be determined based on the operated amount of a stick-type operator of an auxiliary operating unit, for example, a joystick.

Furthermore, although in a preferred embodiment of the present invention, the marine vessel 11 is equipped with the outboard motors 15A and 15B, the marine vessel 11 may be equipped with other types of marine propulsion devices such as inboard/outboard motors (stern drive, inboard motor/outboard drive) and inboard motors. In this case, the marine vessel 11 shifts into the hump state when accelerating, and thus preferred embodiments of the present invention may be applied to this marine vessel 11.

It should be noted that as the posture control plates, interceptor tabs described in Zipwake mentioned above may be used as alternatives to the tab main bodies 21A and 21B. The interceptor tabs are attached to both sides of the stern of the hull 13 and shift their position in substantially the vertical direction. Specifically, in the water, each of the interceptor tabs changes its position from a position at which it projects from a lower surface (bottom) of the hull 13 to a position above the lower surface of the hull 13. The interceptor tabs change the direction of water current by projecting from the lower surface of the hull 13, and thus they generate a larger lift than the lift L generated by the tab main bodies 21A and 21B and consequently generate the bow-down moment 25 as with the tab main bodies 21A and 21B. Thus, if the interceptor tabs are used, it is preferred that the amount of displacement of the interceptor tabs is controlled according to the throttle opening angle.

In addition, at the start of the maneuvering system, whether or not to execute the posture control method according to a preferred embodiment of the present invention (the process in FIG. 9 or the process in FIG. 10) may be set using the setting operating unit 19.

Figure 11:
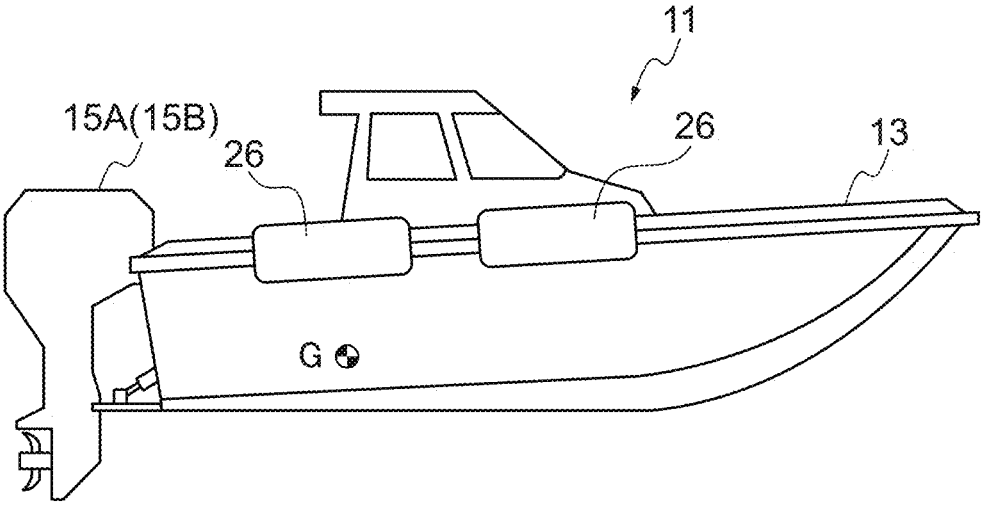
FIG. 11 is a view useful in explaining a first variation to which the posture control system for the hull according to a preferred embodiment of the present invention is applied.

Although in a preferred embodiment of the present invention swinging of the tab main bodies 21A and 21B of the respective trim tab units 20A and 20B is controlled according to the throttle opening angle, that is, the request to accelerate the marine vessel 11 to the predetermined speed, operation of other equipment on the marine vessel 11 may be controlled according to the request to accelerate the marine vessel 11 to the predetermined speed. For example, when the throttle opening angle corresponding to the operated amount of the throttle lever 12 has become equal to the throttle opening angle at which the predetermined speed is achievable, deflation of air cushions 26 (FIG. 11), which are provided on sides of the marine vessel 11 and used to bring the marine vessel 11 alongside a pier, may be started. It takes a predetermined period of time to deflate the air cushions 26. Accordingly, by starting to deflate the air cushions 26 when the throttle opening angle has become equal to the throttle opening angle at which the predetermined speed is achievable, the air cushion 26 are able to be shrunk before the speed of the marine vessel 11 reaches the predetermined speed. As a result, air resistance on the hull 13 is decreased, and the fuel efficiency of the marine vessel 11 is improved.

Figure 12A:
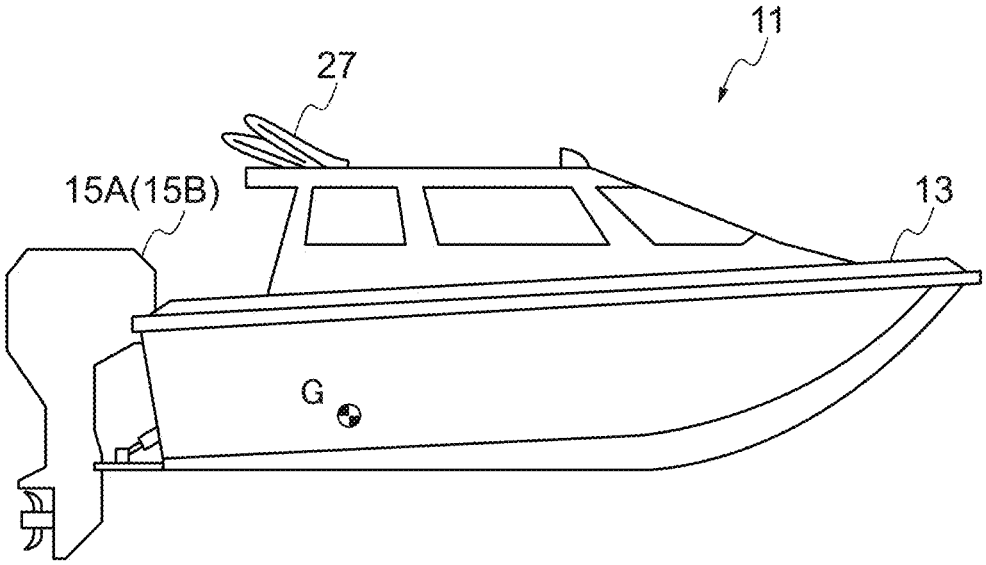
FIGS. 12A and 12B are views useful in explaining a second variation to which the posture control system for the hull according to a preferred embodiment of the present invention is applied.
Figure 12B:
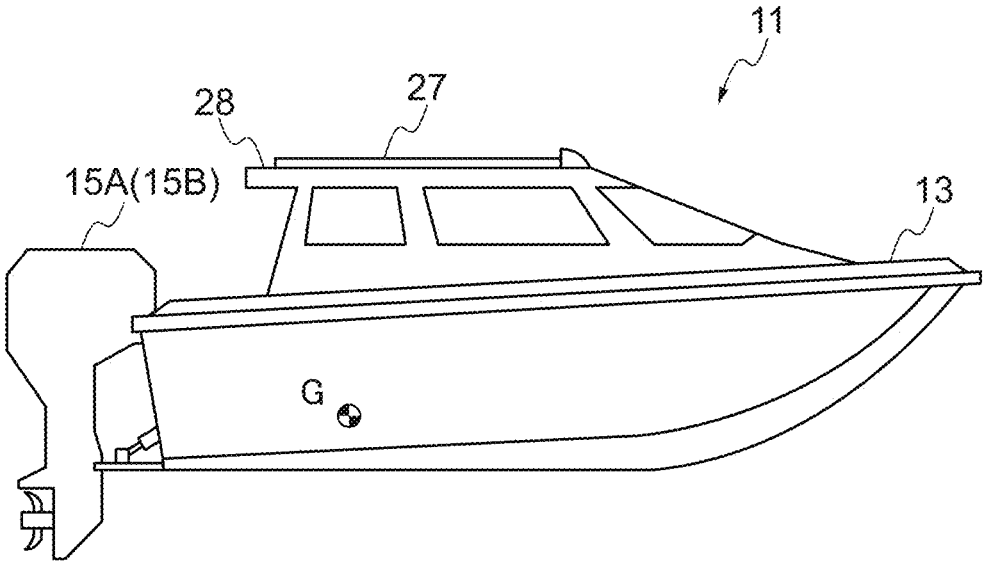

Moreover, when the throttle opening angle corresponding to the operated amount of the throttle lever 12 has become equal to the throttle opening angle at which the predetermined speed is achievable, closure of a movable roof 27 of a collapsible-type such as a canvas top or a sun shade may be started (FIG. 12A). It takes a certain period of time to flatten the top of a cabin 28 as shown in FIG. 12B by closing the movable roof 27. On the other hand, by starting to close the movable roof 27 when the throttle opening angle has become equal to the one at which the predetermined speed is achievable, the top of the cabin 28 is flattened when the marine vessel 11 has reached the predetermined speed. As a result, air resistance on the hull 13 is decreased, and the fuel efficiency of the marine vessel 11 is improved.

It should be noted that when the marine vessel 11 moves backward, the tab main bodies 21A and 21B of the trim tab units 20A and 20B are raised to the position at which the descent rate is 0%, and even if the marine vessel 11 is accelerated, the process in FIG. 9 or FIG. 10 is not carried out, and swinging of the tab main bodies 21A and 21B of the trim tab units 20A and 20B is not controlled.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A posture control system for a hull, the posture control system comprising:

a posture control plate attachable to a stern of the hull to control a posture of the hull;

a driver to drive the posture control plate;

a marine propulsion device to generate a propulsive force for the hull; and a controller configured or programmed to control the driver; wherein the marine propulsion device is separate from the posture control plate; and based on a throttle opening angle of an engine of the marine propulsion device, the controller is configured or programmed to determine a time when the posture control plate is to be lowered by the driver.

2. The posture control system according to claim 1, wherein the controller is configured or programmed to cause the driver to lower the posture control plate at a time when the controller judges that the throttle opening angle of the engine corresponds to a request to accelerate the hull to a predetermined speed.

3. The posture control system according to claim 2, wherein the predetermined speed is a speed at which, after the hull is accelerated to the predetermined speed, fuel efficiency is better in a case in which the posture control plate is lowered than in a case in which the posture control plate is not lowered.

4. The posture control system according to claim 2, wherein the predetermined speed is a speed at which the hull shifts into a hump state.

5. The posture control system according to claim 1, wherein the controller is configured or programmed to determine the throttle opening angle of the engine according to an operated amount of a throttle operator.

6. The posture control system according to claim 1, wherein the throttle opening angle of the engine is obtained by measuring an actual opening angle of a throttle valve.

7. The posture control system according to claim 1, wherein the controller is configured or programmed to cause the driver to raise the lowered posture control plate at a predetermined time after causing the driver to lower the posture control plate.

8. The posture control system according to claim 7, wherein the predetermined time is when the controller judges that the throttle opening angle of the engine corresponds to a request to accelerate the hull to a speed at which the hull shifts into a planing state.

9. The posture control system according to claim 7, wherein the predetermined time is when the controller judges that the throttle opening angle of the engine corresponds to a request to accelerate the hull to a speed at which fuel efficiency is better in a case in which the posture control plate is not lowered than in a case in which the posture control plate is lowered.

10. A posture control system for a hull, the posture control system comprising:

a marine propulsion device to generate a propulsive force on the hull;

a posture control plate to control a posture of the hull, the posture control plate being separate from the marine propulsion device; and a controller configured or programmed to, based on a throttle opening angle of an engine of the marine propulsion device, judge whether or not the hull has accelerated to a predetermined speed, and lower the posture control plate at a time when the controller judges that the hull is to be accelerated to the predetermined speed.

11. A control method for a posture control system for a hull, the posture control system including a posture control plate attachable to a stern of the hull to control a posture of the hull, a driver to drive the posture control plate, a marine propulsion device to generate a propulsive force for the hull, and a controller configured or programmed to control the driver, the method comprising:

based on a throttle opening angle of an engine of the marine propulsion device, determining with the controller a time when the posture control plate is to be lowered by the driver; wherein the marine propulsion device is separate from the posture control plate.

12. A marine vessel comprising:

a hull; and a posture control system for the hull, the posture control system including:

a posture control plate attached to a stern of the hull to control a posture of the hull;

a driver to drive the posture control plate;

a marine propulsion device to generate a propulsive force for the hull; and a controller configured or programmed to control the driver; wherein the marine propulsion device is separate from the posture control plate; and based on a throttle opening angle of an engine of the marine propulsion device, the controller is configured or programmed to determine a time when the posture control plate is to be lowered by the driver.

13. A posture control system for a hull, the posture control system comprising:

a posture control plate attachable to a stern of the hull to control a posture of the hull;

a driver to drive the posture control plate;

a marine propulsion device to generate a propulsive force for the hull; and a controller configured or programmed to controls the driver; wherein the marine propulsion device is separate from the posture control plate; and based on an operated amount of a throttle operator, the controller is configured or programmed to determine a time when the posture control plate is to be lowered by the driver.

14. The posture control system according to claim 13, wherein the controller is configured or programmed to cause the driver to lower the posture control plate at a time when the controller judges that the operated amount of the throttle operator corresponds to a request to accelerate the hull to a predetermined speed.

15. The posture control system according to claim 14, wherein the predetermined speed is a speed at which, after the hull is accelerated to the predetermined speed, fuel efficiency is better in a case in which the posture control plate is lowered than in a case in which the posture control plate is not lowered.

16. The posture control system according to claim 14, wherein the predetermined speed is a speed at which the hull shifts into a hump state.

17. The posture control system according to claim 13, wherein, after causing the driver to lower the posture control plate, the controller is configured or programmed to cause the driver to raise the lowered posture control plate at a predetermined time.

18. The posture control system according to claim 17, wherein the predetermined time is when the controller judges that the operated amount of the throttle operator corresponds to a request to accelerate the hull to a speed at which the hull shifts into a planing state.

19. The posture control system according to claim 17, wherein the predetermined time is when the controller judges that the operated amount of the throttle operator corresponds to a request to accelerate the hull to a speed at which fuel efficiency is better in a case in which the posture control plate is not lowered than in a case in which the posture control plate is lowered.

* * * * *